US009064486B2

(12) United States Patent
Sato

(10) Patent No.: US 9,064,486 B2
(45) Date of Patent: Jun. 23, 2015

(54) ULTRASONIC SENSOR

(75) Inventor: Takehiro Sato, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 279 days.

(21) Appl. No.: 13/111,201

(22) Filed: May 19, 2011

(65) Prior Publication Data

US 2011/0290584 A1 Dec. 1, 2011

(30) Foreign Application Priority Data

May 28, 2010 (JP) ..... 2010-123603

(51) Int. Cl.
*B06B 1/06* (2006.01)
*G10K 9/122* (2006.01)
*G10K 11/00* (2006.01)

(52) U.S. Cl.
CPC ..... *G10K 9/122* (2013.01); *B06B 1/0644* (2013.01); *B06B 1/0685* (2013.01); *G10K 11/002* (2013.01)

(58) Field of Classification Search
CPC ..... B06B 1/06; B06B 1/0644; B06B 1/0651; B06B 1/0674; B06B 1/0677; B06B 1/0681; B06B 1/0685
USPC ..... 310/327, 334, 345
See application file for complete search history.

(56) References Cited

U.S. PATENT DOCUMENTS 3,821,834 A * 7/1974 McElroy ..... 29/25.35
3,855,847 A 12/1974 Leschek
3,890,423 A * 6/1975 Zacharias, Jr. ..... 310/335
3,950,660 A * 4/1976 McElroy ..... 310/336
4,081,889 A * 4/1978 Levine ..... 29/25.35
4,420,707 A * 12/1983 VanValkenburg ..... 310/327
4,437,032 A * 3/1984 Gelhard ..... 310/324
6,396,198 B1 * 5/2002 Okimura et al. ..... 310/334
7,545,082 B2 6/2009 Nakajima
7,728,486 B2 6/2010 Matsuo
7,737,609 B2 * 6/2010 Murata et al. ..... 310/348
8,264,124 B2 * 9/2012 Matsumoto et al. ..... 310/326
8,288,920 B2 * 10/2012 Mueller et al. ..... 310/326

(Continued)

FOREIGN PATENT DOCUMENTS

CH 569 280 A5 11/1975
CN 1882197 A 12/2006

(Continued)

OTHER PUBLICATIONS

German Office Action issued for corresponding application DE10 2011 076 395.3, dated Feb. 27, 2014 (English translation attached).

*Primary Examiner* — Derek Rosenau
(74) *Attorney, Agent, or Firm* — Arent Fox LLP

(57) ABSTRACT

An ultrasonic sensor includes a substantially cylindrical case including a bottom portion and a side wall portion and a plurality of members disposed within the case. A reinforcement having a substantially ring shape is fitted on a thick section in the case at a location that is not in contact with an inner surface of a thin section of the side wall portion. A piezoelectric element is attached to an inner bottom surface of the case. An elastic member is fitted on the reinforcement so as to cover a substantially ring-shaped opening region of the reinforcement. A gap between the elastic member and an inner circumferential surface of the case is filled with a first filler. The terminal holding member is placed on the elastic member. A surrounding region of the terminal holding member is filled with a second filler.

4 Claims, 10 Drawing Sheets

(56) References Cited

U.S. PATENT DOCUMENTS

| | | | | |
|---|---|---|---|---|
| 2008/0184802 | A1 | 8/2008 | Sato | |
| 2008/0309199 | A1* | 12/2008 | Furukawa | 310/334 |
| 2010/0296692 | A1 | 11/2010 | Reiche | |
| 2011/0074246 | A1* | 3/2011 | Nishie et al. | 310/327 |

FOREIGN PATENT DOCUMENTS

| | | | |
|---|---|---|---|
| CN | 101241183 | A | 8/2008 |
| CN | 101258772 | A | 9/2008 |
| CN | 101529927 | A | 9/2009 |
| DE | 199 27 797 | C1 | 12/2000 |
| DE | 103 41 900 | A1 | 6/2004 |
| EP | 0 477 575 | A1 | 4/1992 |
| JP | 2000-32594 | | 1/2000 |
| JP | 2005-072771 | A | 3/2005 |
| KR | 20030008715 | A | 1/2003 |
| KR | 10-2009-0074055 | A | 7/2009 |

* cited by examiner

ULTRASONIC SENSOR

BACKGROUND OF THE INVENTION

1. Field of the Invention

The present invention relates to ultrasonic sensors and, in particular, an ultrasonic sensor that includes a piezoelectric element and an input/output terminal electrically coupled thereto and that can be used in automotive corner sonar or back sonar, for example.

2. Description of the Related Art

An ultrasonic sensor uses ultrasonic waves in sensing and detects an object by intermittently transmitting an ultrasonic pulse signal and receiving a reflected wave from the obstacle present in neighboring areas. An ultrasonic sensor can be employed in automotive back sonar, corner sonar and, additionally, a parking sensor for detecting the presence of a space to an obstacle, such as a side wall, in parallel parking.

An example of this type of ultrasonic sensor is described in Japanese Unexamined Patent Application Publication No. 2000-32594. FIG. 1 is a cross-sectional view of an ultrasonic sensor 30 illustrated in this patent literature. The ultrasonic sensor 30 includes a case 31 including a bottom portion 32 and a side wall portion 34, a piezoelectric element 35, a sound absorber 36, an insulation material 37, and a cable 40. The piezoelectric element 35 is fixed to the inner surface of the bottom portion 32 of the case 31 and has a first electrode electrically coupled to the case 31. The inside of the case 31 is filled with the sound absorber 36 and the insulation material 37 having elasticity. A temperature-compensating single-panel capacitor 38 is embedded in the insulation material 37. The single-panel capacitor 38 has a first external electrode connected to the case 31 and a second external electrode connected to a second electrode of the piezoelectric element 35 with a lead 39 disposed therebetween. The cable 40 includes two signal lines 41 for use in inputting and outputting a signal. The two signal lines 41 are connected to their respective external electrodes of the single-panel capacitor 38.

A traditional ultrasonic sensor illustrated in FIG. 1 achieves good reverberation characteristics by being filled with the insulation material 37 having elasticity. However, such an ultrasonic sensor having a pin terminal structure in which a pin protrudes from a case has two major drawbacks described below.

(1) To suppress vibration of the side wall of the case and obtain good reverberation characteristics, it is necessary to fill the inside with an insulation material having a high modulus of elasticity for efficiently suppressing vibration of the case (hereinafter referred to as "filler"). However, if the inside is filled with a filler having a high modulus of elasticity, not all vibration transmitted from the side wall of the case toward the filler can be absorbed by the filler, and the vibration is transmitted to the pin terminal. This vibration leaks through the pin terminal to a substrate on which the sensor is implemented. The leakage of the vibration through the terminal is hereinafter referred to simply as "vibration leakage." If there is vibration leakage, an unnecessary signal component (pseudo noise) is detected, and this is a serious problem for an ultrasonic sensor for sensing an object.

(2) In contrast to the above situation, in order to have a structure that prevents transmission of vibration to the pin terminal and avoids vibration leakage, it is necessary to fill the inside with a filler having a low modulus of elasticity. However, if the inside is filled with such a filler having a low modulus of elasticity, vibration of the side wall of the case cannot be sufficiently suppressed, and this increases the reverberation time. If the reverberation time is long, an obstacle at a short distance is not detectable.

FIG. 2 is a conceptual illustration of reverberation characteristics and vibration leakage characteristics with respect to a modulus of elasticity of a filler. In FIG. 2, the curve R represents the reverberation characteristics, and the curve V represents the vibration leakage characteristics. The horizontal axis indicates the modulus of elasticity, and the vertical axis indicates the time. The vibration leakage characteristics are a change in reverberation time between a discrete state of an ultrasonic sensor and a state where the ultrasonic sensor is implemented on a substrate. As illustrated, the reverberation time reduces with an increase in the modulus of elasticity of the filler, whereas the vibration leakage increases with an increase in the modulus of elasticity.

FIGS. 3A, 3B, and 3C illustrate vibration characteristics of three ultrasonic sensors having different moduli of elasticity. FIG. 3A illustrates characteristics of an ultrasonic sensor filled with elastic resin having a relatively low modulus of elasticity; FIG. 3C illustrates characteristics of an ultrasonic sensor filled with elastic resin having a relatively high modulus of elasticity; and FIG. 3B illustrates characteristics of an ultrasonic sensor filled with elastic resin having a modulus of elasticity between that illustrated in FIG. 3A and that in FIG. 3C. For the example of FIG. 3A, whose attenuation pattern is simple, no vibration leakage occurs, but the reverberation time is long. For the example of FIG. 3C, in which multiple types of vibration interfere with each other and thus a complex attenuation pattern appears, vibration leakage occurs. For the example of FIG. 3B, whose attenuation pattern is between that illustrated in FIG. 3A and that in FIG. 3C, vibration leakage occurs and reverberation time is long.

As described above, simply selecting an appropriate modulus of elasticity is insufficient for adequately improving both reverberation characteristics and vibration leakage.

SUMMARY OF THE INVENTION

Accordingly, it is an object of the present invention to provide an ultrasonic sensor capable of improving both reverberation characteristics and vibration leakage and achieving short-range detection with high sensitivity.

According to preferred embodiments of the present invention, an ultrasonic sensor includes a substantially cylindrical case including a bottom portion and a side wall portion, a piezoelectric element attached to an inner bottom surface of the case, a terminal extending outside the case, a conductive member that connects the terminal and an electrode of the piezoelectric element, and a filler with which an inside of the case is filled. The filler includes a first filler being in contact with the side wall portion of the case and a second filler surrounding the terminal. The first filler has a modulus of elasticity higher than that of the second filler.

With this configuration, the second filler can absorb vibration from the side wall portion of the case, propagation of vibration to the terminal in the case, e.g., a pin terminal, can be suppressed, and vibration leakage can be suppressed. The first filler can reduce vibration of the side wall portion of the case, and satisfactory reverberation characteristics are obtainable.

The ultrasonic sensor may further include an elastic member arranged at a location that is not in contact with the side wall portion between the second filler and the piezoelectric element. At least a gap between the side wall portion and the elastic member may be filled with the first filler.

With this structure, vibration transmitted from the case is attenuated in the elastic member and is not virtually propagated to the terminal. Therefore, an effect of suppressing vibration leakage can be enhanced.

The ultrasonic sensor may further include a sound absorber disposed in a space between the piezoelectric element and the elastic member and be provided at a surface of the elastic member, the surface being adjacent to the piezoelectric element.

With this structure, the sound absorber can absorb an unnecessary sound wave. Thus an unnecessary sound wave transmitted from the piezoelectric element toward the inside of the case can be attenuated more efficiently.

With preferred embodiments of the present invention, an ultrasonic sensor that has a short reverberation time and less vibration leakage is obtainable. This ultrasonic sensor can achieve short-range detection with high sensitivity.

Other features, elements, characteristics and advantages of the present invention will become more apparent from the following detailed description of preferred embodiments of the present invention with reference to the attached drawings.

DESCRIPTION OF THE PREFERRED EMBODIMENTS

First Embodiment

Figure 4:
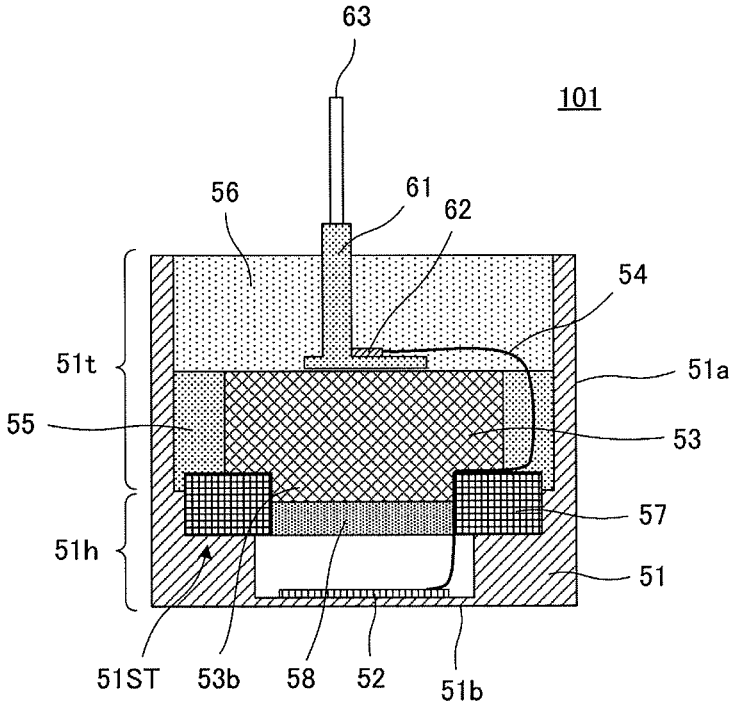
FIG. 4 is a cross-sectional view of an ultrasonic sensor according to a first embodiment.

FIG. 4 is a cross-sectional view of an ultrasonic sensor 101 according to a first embodiment. The ultrasonic sensor 101 includes a substantially cylindrical case 51 including a bottom portion 51*b* and a side wall portion 51*a* and a plurality of members disposed in this case 51. The case 51 can be an aluminum compact, for example. The side wall portion 51*a* includes a thin section 51*t* at its opening side and a thick section 51*h* at its bottom side. The bottom portion 51*b* has a hollow having the shape of a substantially oval with long and short axes. Both ends of the hollow in the short-axis direction are the thin section 51*h*.

Reinforcement (weight) 57 having a substantially ring shape is fitted on the thick section 51*h* in the case 51 at a location 51ST that is not in contact with an inner surface of the thin section 51*t* of the side wall portion 51*a*. The reinforcement (weight) 57 can be a member that has higher acoustic impedance than that of the case 51. For example, the reinforcement 57 may be a compact made of the same material (aluminum) as in the case 51 and molded so as to have high acoustic impedance than that of the case 51 by adjustment of its thickness and shape. Alternatively, the reinforcement 57 may have high acoustic impedance using a material having a higher density than that of the case 51, such as stainless steel or zinc.

A piezoelectric element 52 is attached to an inner bottom surface of the case 51.

An elastic member 53 is fitted on the reinforcement 57 so as to cover a substantially ring-shaped opening region 53*b* of the reinforcement 57. The gap between the elastic member 53 and the inner circumferential surface of the case 51 is filled with a first filler 55.

A terminal holding member 61 holds two pins. A first end of the two pins held by the terminal holding member 61 is an external terminal 63, and a second end thereof is an internal terminal 62. The internal terminal 62 and an electrode of the piezoelectric element 52 are connected together by a wiring material (conductive member) 54 disposed therebetween. The terminal holding member 61 is placed on the elastic member 53. The surrounding region of the terminal holding member 61 is filled with a second filler 56. The terminal holding member 61 is partly embedded in the second filler 56, thereby fixing the terminal holding member 61 inside the case 51 using the second filler 56.

A sound absorber 58 is disposed on a surface of the elastic member 53 that is adjacent to the piezoelectric element 52. The sound absorber 58 can be a polyester felt, for example, and be bonded to the elastic member 53 with an adhesive.

The first filler 55 is in contact with the side wall portion 51*a* of the case 51. The second filler 56 is in contact with the terminal holding member 61. Here, it is effective to avoid the first filler 55 from being in contact with the outer area of the terminal holding member 61. In this case, vibration transmitted from the side wall portion 51*a* of the case 51 can be reliably prevented from being transmitted to the terminal holding member 61, and vibration leakage can be suppressed. If an effect of suppressing vibration leakage is not strongly required, the first filler 55 may be in slight contact with the terminal holding member 61 as long as a major portion of the outer area of the terminal holding member 61 is covered with the second filler 56. The modulus of elasticity of the first filler 55 is higher than that of the second filler 56. For example, the first filler 55 can be urethane resin, and the second filler 56 can be silicone resin. Alternatively, both may be urethane resin if they have different moduli of elasticity. The first filler 55 can be an elastic member having higher vibration suppression with respect to the side wall portion 51*a* of the case 51. The second filler 56 can be an elastic member that does not easily allow propagation of vibration of the side wall portion 51*a* to the terminal holding member 61.

Figure 1:
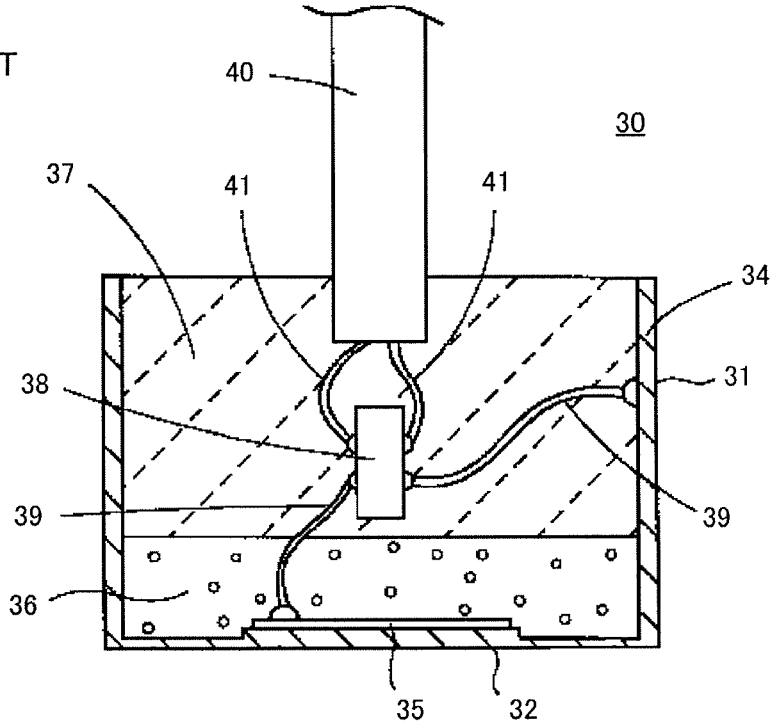
FIG. 1 PRIOR ART
FIG. 1 is a cross-sectional view of an ultrasonic sensor according to an example of related art.
Figure 2:
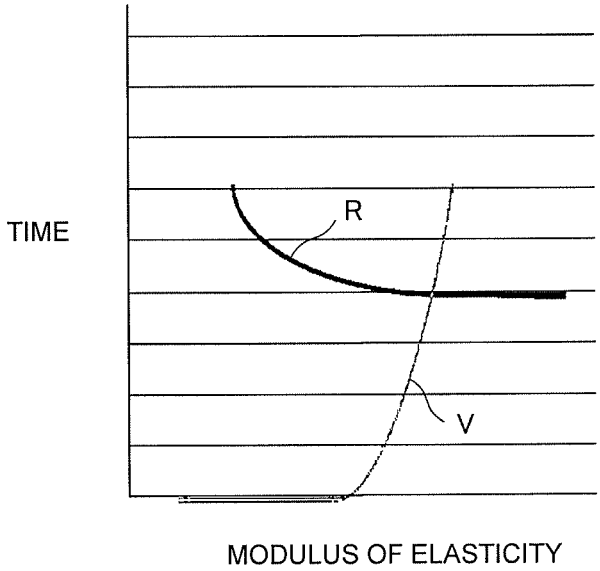
FIG. 2 PRIOR ART
FIG. 2 is a conceptual illustration of reverberation characteristics and vibration leakage characteristics with respect to a modulus of elasticity of a filler.
Figure 3A:
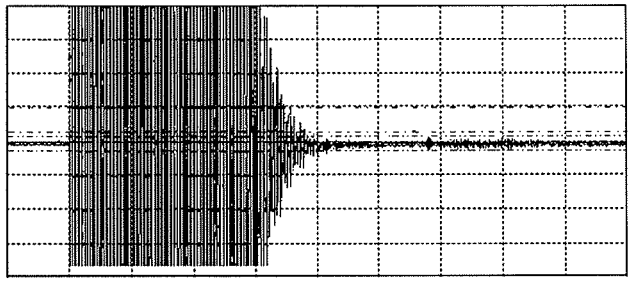
FIG. 3A PRIOR ART
FIGS. 3A, 3B, and 3C illustrate vibration characteristics of three ultrasonic sensors having different moduli of elasticity.
Figure 3B:
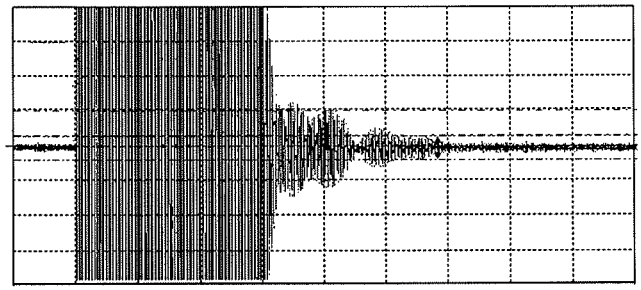
FIG. 3B PRIOR ART
Figure 3C:
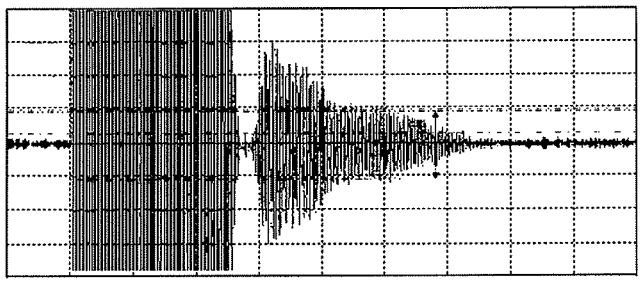
FIG. 3C PRIOR ART
Figure 5:
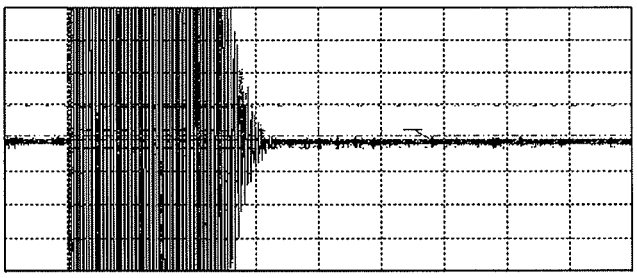
FIG. 5 illustrates vibration characteristics of the ultrasonic sensor according to the first embodiment.

FIG. 5 illustrates vibration characteristics of the ultrasonic sensor 101 according to the first embodiment. The horizontal and vertical axes in FIGS. 3A to 3C and FIG. 5 are in substantially the same scale. The measurement conditions in FIG. 5 are also substantially the same as those at which the results illustrated in FIGS. 3A to 3C are obtained. FIG. 5 illustrates an observation of a voltage waveform appearing in the piezoelectric element after sending of a burst wave. Actually, the amplitude starts attenuating immediately after the sending. However, because it exceeds a dynamic range of an amplifying circuit for a certain period of time, the waveform is saturated for that period.

FIG. 5 reveals that its attenuation pattern is simple, similar to that in FIG. 3A, and thus no vibration leakage occurs and that its reverberation time is shorter than that in FIG. 3A and thus the reverberation characteristics are also excellent.

Second Embodiment

Figure 6:
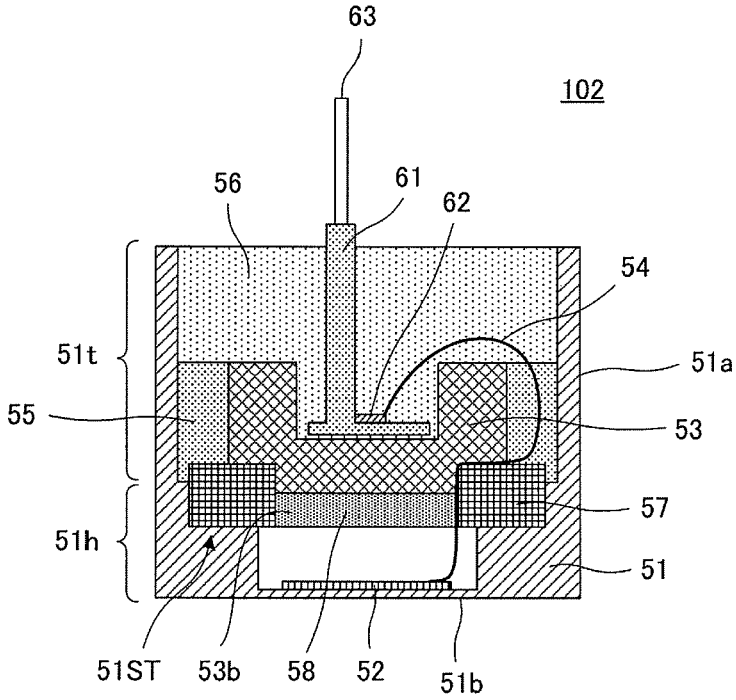
FIG. 6 is a cross-sectional view of an ultrasonic sensor according to a second embodiment.

FIG. 6 is cross-sectional view of an ultrasonic sensor 102 according to a second embodiment. For the ultrasonic sensor 102, the elastic member 53 has a recess in the upper surface, and the terminal holding member 61 is arranged in the recess. The bottom of the terminal holding member 61 is at a deep location within the case 51. Therefore, the terminal holding member 61 in the ultrasonic sensor 102 is longer than that illustrated in FIG. 4. The other configuration is substantially the same as in the ultrasonic sensor 101 illustrated in the first embodiment.

With the structure illustrated in FIG. 6, the terminal holding member 61 is in contact with the second filler 56 over a long distance, and this second filler 56 virtually prevents propagation of vibration from the side wall portion 51*a* of the case 51 to the terminal holding member 61 and its inner pins. Therefore, no vibration leakage occurs, and durability to withstand undesired pullout or separation of the terminal holding member 61 can be increased.

Third Embodiment

Figure 7:
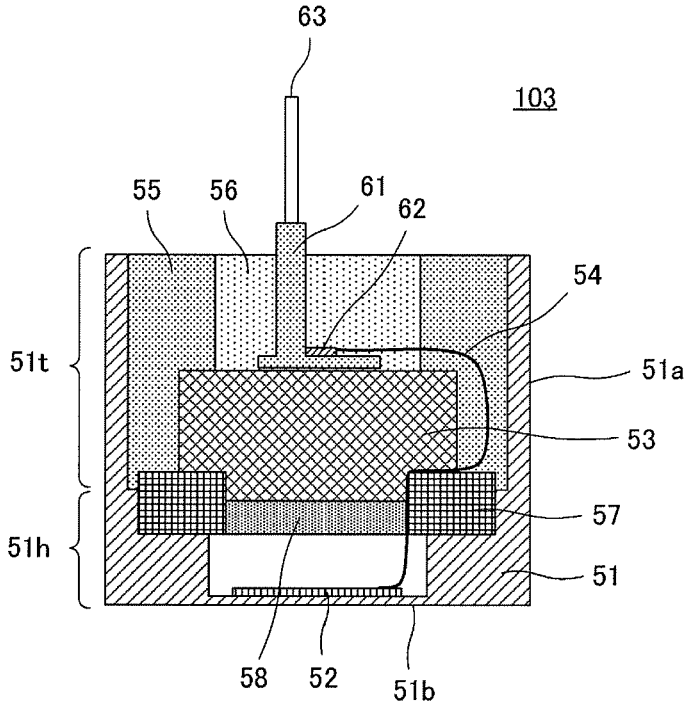
FIG. 7 is a cross-sectional view of an ultrasonic sensor according to a third embodiment.

FIG. 7 is a cross-sectional view of an ultrasonic sensor 103 according to a third embodiment. For the ultrasonic sensor 103, the first filler 55 in the case 51 extends over the entire inner surface of the thin section 51*t* of the side wall portion 51*a* of the case 51. The gap between the first filler 55 and the terminal holding member 61 is filled with the second filler 56. The other configuration is substantially the same as in the ultrasonic sensor 101 illustrated in the first embodiment.

With the structure illustrated in FIG. 7, because the first filler 55 is in contact with the wide range of the side wall portion 51*a* of the case 51, the ultrasonic sensor can achieve more satisfactory reverberation characteristics.

Fourth Embodiment

Figure 8:
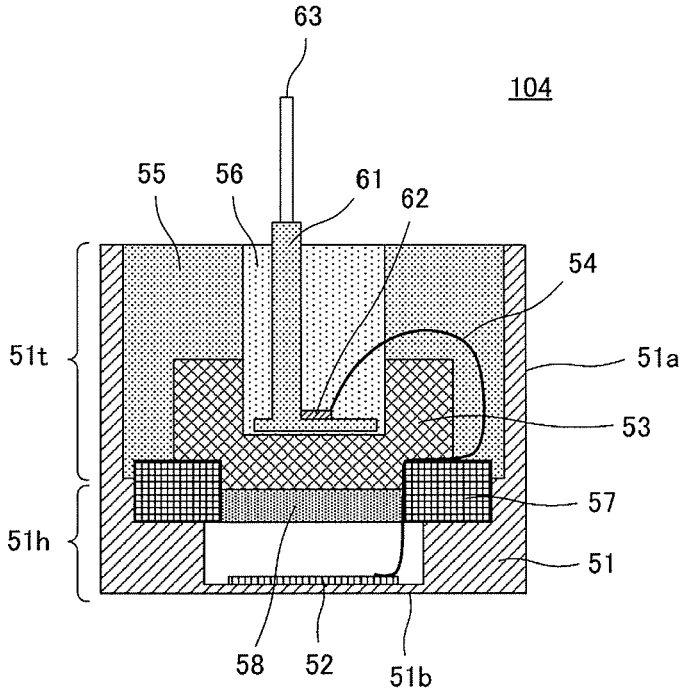
FIG. 8 is a cross-sectional view of an ultrasonic sensor according to a fourth embodiment.

FIG. 8 is a cross-sectional view of an ultrasonic sensor 104 according to a fourth embodiment. For the ultrasonic sensor 104, the first filler 55 in the case 51 extends over the entire inner surface of the thin section 51*t* of the side wall portion 51*a* of the case 51. The elastic member 53 has a recess in its upper surface, and the terminal holding member 61 is arranged in the recess. The bottom of the terminal holding member 61 is at a deep location within the case 51. Therefore, the terminal holding member 61 in the ultrasonic sensor 104 is longer than that illustrated in FIG. 4. A surrounding region of the terminal holding member 61 that is not filled with the first filler 55 is filled with the second filler 56. The other configuration is substantially the same as in the ultrasonic sensor 101 illustrated in the first embodiment.

With the structure illustrated in FIG. 8, because the first filler 55 is in contact with the wide range of the side wall portion 51*a* of the case 51, the ultrasonic sensor can achieve satisfactory reverberation characteristics. In addition, because the terminal holding member 61 is in contact with the second filler 56 over a long distance, no vibration leakage occurs, and durability to withstand undesired pullout or separation of the terminal holding member 61 can be increased.

Fifth Embodiment

Figure 9:
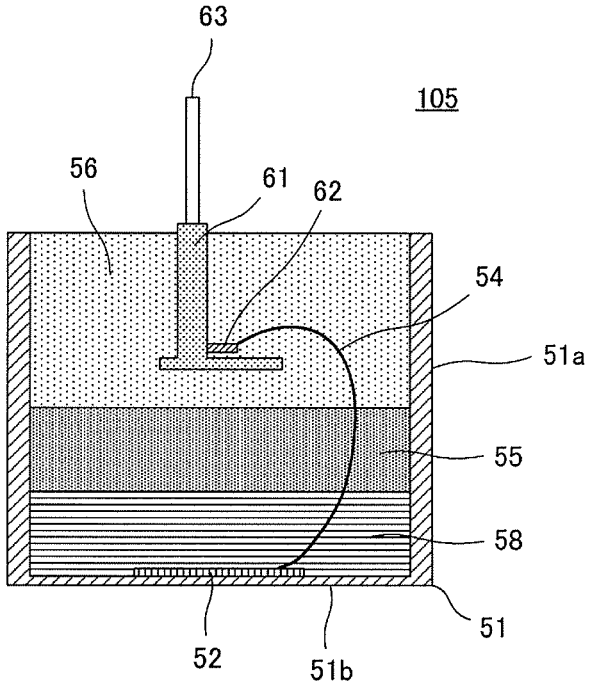
FIG. 9 is a cross-sectional view of an ultrasonic sensor according to a fifth embodiment.

FIG. 9 is a cross-sectional view of an ultrasonic sensor 105 according to a fifth embodiment. The ultrasonic sensor 105 includes the substantially cylindrical case 51 including the bottom portion 51*b* and the side wall portion 51*a* and the plurality of member disposed in this case 51.

The piezoelectric element 52 is attached to the inner bottom surface of the case 51. The sound absorber 58 having a specific thickness is disposed on the inner bottom surface of the case 51. A region above the sound absorber 58 is filled with the first filler 55 having a specific thickness. A region above the first filler 55 is filled with the second filler 56. The terminal holding member 61 holds the two pins. The first end of the two pins held by the terminal holding member 61 is the external terminal 63, and the second end thereof is the internal terminal 62. The terminal holding member 61 is not in contact with the first filler 55 and is partly embedded in the second filler 56.

As described above, preferred embodiments are also applicable to an ultrasonic sensor of a type in which no elastic member is arranged between the second filler 56 and the piezoelectric element 52. That is, the inside of the case 51 can be filled with the first filler 55 and the second filler 56 such that the first filler 55 is not in contact with the terminal holding member 61 but is in contact with the side wall portion 51*a* of the case 51 and such that the second filler 56 is in contact with the terminal holding member 61.

Sixth Embodiment

Figure 10:
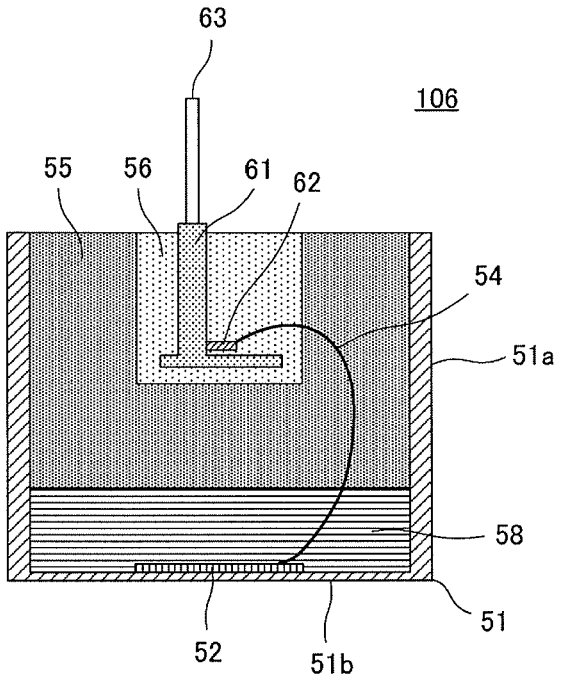
FIG. 10 is a cross-sectional view of an ultrasonic sensor according to a sixth embodiment.

FIG. 10 is a cross-sectional view of an ultrasonic sensor 106 according to a sixth embodiment. The ultrasonic sensor 106 includes the substantially cylindrical case 51 including the bottom portion 51*b* and the side wall portion 51*a* and the plurality of member disposed in this case 51.

The piezoelectric element 52 is attached to the inner bottom surface of the case 51. The sound absorber 58 having a specific thickness is disposed on the inner bottom surface of the case 51. A region above the sound absorber 58 is filled with the first filler 55 being in contact with the side wall portion 51*a* of the case 51. Note that there is a recess that is not filled with the first filler 55 at an opening surface side of the case 51. The recess is filled with the second filler 56. The terminal holding member 61 holds the two pins, of which a first end is the external terminal 63 and a second end is the internal terminal 62. The terminal holding member 61 is not in contact with the first filler 55 and is partly embedded in the second filler 56.

As described above, because the first filler 55 is in contact with the wide range of the side wall portion 51*a* of the case 51, the ultrasonic sensor can achieve more satisfactory reverberation characteristics.

In the embodiments described above, the terminal holding member 61 holds the pin terminals. However, the second filler 56 may be in direct contact with the pin terminals.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. An ultrasonic sensor comprising:

a case including a bottom portion and a side wall portion that define an inner space;

a piezoelectric element located within the inner space of the case and attached to the bottom portion of the case;

a terminal positioned within the inner space of the case and extending outside the case;

a conductive member that connects the terminal and an electrode of the piezoelectric element;

a first filler located within the inner space of the case so as to contact the side wall portion of the case; and a second filler surrounding the terminal, wherein the first filler has a modulus of elasticity higher than that of the second filler, wherein the side wall portion of the case includes a first section adjacent the bottom portion and a second section adjacent the first section, the first section being thicker than the second section, and the first section includes a hollow portion sized to accommodate the piezoelectric element, the ultrasonic sensor further comprising:

a reinforcement at the first section of the side wall portion and disposed so as to not contact the second section of the side wall portion;

an elastic member disposed on the reinforcement and between the second filler and the piezoelectric element and not contacting the side wall portion of the case, such that a gap between the side wall portion and the elastic member is filled with the first filler; and a sound absorber disposed between the piezoelectric element and the elastic member.

2. The ultrasonic sensor according to claim 1, wherein the elastic member has a recess, and the terminal is arranged in the recess.

3. The ultrasonic sensor according to claim 1, wherein the sound absorber is disposed on a surface of the elastic member adjacent to the piezoelectric element.

4. The ultrasonic sensor according to claim 1, wherein the sound absorber is disposed between the piezoelectric element and the first filler.

* * * * *